US007104418B2

(12) United States Patent
Kamenstein

(10) Patent No.: US 7,104,418 B2
(45) Date of Patent: Sep. 12, 2006

(54) DISPENSER FOR ROLLED MATERIALS

(75) Inventor: Matthew Kamenstein, New York, NY (US)

(73) Assignee: Lifetime Hoan Corporation, Westbury, NY (US)

( * ) Notice: Subject to any disclaimer, the term of this patent is extended or adjusted under 35 U.S.C. 154(b) by 0 days.

(21) Appl. No.: 10/903,676

(22) Filed: Jul. 30, 2004

(65) Prior Publication Data

US 2005/0056718 A1 Mar. 17, 2005

Related U.S. Application Data

(63) Continuation-in-part of application No. 10/335,420, filed on Dec. 31, 2002, now Pat. No. 6,793,097.

(51) Int. Cl.
*B65H 1/00* (2006.01)

(52) U.S. Cl. ..... 221/33; 221/44; 221/42

(58) Field of Classification Search ..... 221/33, 221/45, 277; 242/597.7, 419, 419.8, 419.9, 242/422.4, 422.9, 597.5, 597.6, 571, 571.5
See application file for complete search history.

(56) References Cited

U.S. PATENT DOCUMENTS

| | | | | |
|---|---|---|---|---|
| 1,762,516 | A * | 6/1930 | Hlavac | 242/571.5 |
| 2,562,923 | A * | 8/1951 | Kolivoski | 242/571.5 |
| 6,357,687 | B1 * | 3/2002 | Liu | 242/422.4 |
| 6,793,097 | B1 * | 9/2004 | Kamenstein | 221/33 |

* cited by examiner

*Primary Examiner*—Gene O. Crawford
*Assistant Examiner*—Timothy Waggoner
(74) *Attorney, Agent, or Firm*—Jenkens & Gilchrist, PC

(57) ABSTRACT

A dispenser for paper, plastic, foil and other goods that are supplied on rolls or tubes. The dispenser includes a rotation mechanism including a plurality of flexible wires for receiving a first end portion of the plurality of flexible wires. The rotation mechanism further includes a freely rotating cap, a freely rotating spinner and a mechanism for providing resistance to the freely rotating spinner.

21 Claims, 10 Drawing Sheets

DISPENSER FOR ROLLED MATERIALS

RELATED APPLICATIONS

This patent application is a continuation-in-part of, and incorporates by reference the entire disclosure of, U.S. patent application Ser. No. 10/335,420, filed on Dec. 31, 2002 now U.S. Pat. No. 6,793,097.

BACKGROUND OF THE INVENTION

1. Technical Field of the Invention

The present invention relates in general to holders and more specifically to holders for paper, plastic, foil, tape or other goods. In particular, the present invention relates to a dispenser for paper, plastic, foil, tape or other goods that are supplied as sheets or rolls of any length and width which prevents the material from unraveling from the roll when a desired quantity is torn from the roll.

2. Description of Related Art

A number of household paper, plastic, tape and foil goods in common use are supplied as continuous sheets on rolls or tubes. The most common examples of these are paper towels, toilet paper, plastic wrap, adhesive tape and aluminum foil. In a number of cases the sheets are perforated at regular intervals to allow an individual to select a desired quantity of material and easily separate it from the roll. Dispensing of these materials is made even easier by a variety of dispensing devices that are used to mount the roll or tube on dowel or rod to allow easy unraveling of the sheets from the roll. A drawback of most dispensers is that because the roll of product is allowed to rotate freely, the force required to separate individual sheets from the roll frequently results in excess material being unraveled from the roll.

None of the prevalent prior art solutions provide an effective means for dispensing rolled materials without unraveling excess material from the roll.

Therefore, there is a need for a dispenser for rolled products which allows only a desired quantity of the product to be unraveled.

SUMMARY OF THE INVENTION

A dispenser for paper, plastic, foil, tape and other goods that are supplied on rolls or tubes of any length and width includes a rotation mechanism including a plurality of flexible wires connected to a freely rotating cap for receiving a first end portion of the plurality of flexible wires. The rotation mechanism further includes a sleeve, a freely rotating spinner and a friction mechanism for providing resistance to the freely rotating spinner.

In another embodiment of the present invention, the plurality of flexible wires are replaced by a cylindrical body. The cylindrical body is connected at one end to the freely rotating cap and at the other end to the freely rotating spinner.

In an embodiment of the invention, the spinner is substantially circular in shape and includes a plurality of circumferential ridges and divots, while the friction mechanism includes a friction disc comprising a plurality of protrusions to engage the ridges and divots and create resistance to rotation of the spinner.

In another embodiment of the present invention, the friction mechanism further comprises a loop including a protrusion extending from an outer surface of the loop to engage the ridges and divots and create resistance to rotation of the spinner.

In another embodiment of the present invention, the friction mechanism further includes a hub, a spring mechanism and a plunger attached to the spring mechanism to engage the ridges and divots and create resistance to rotation of the spinner.

BRIEF DESCRIPTION OF THE DRAWINGS

A more complete understanding of the dispenser of the present invention may be acquired by reference to the following Detailed Description when taken in conjunction with the accompanying Drawings wherein.

DETAILED DESCRIPTION OF THE DRAWINGS

With reference now to the drawings, and in particular to FIGS. 1A–9 thereof, embodiments of a novel rotation mechanism for a dispenser 100 embodying the principles and concepts of the present invention will be described. While the embodiments described herein are intended as an exemplary dispenser (for paper, plastic, tape, foil), it will be appreciated by those skilled in the art that the present invention is not limited for dispensing paper, and may be employed for dispensing any sheet product supplied on rolls or tubes of any length and width.

Referring now to FIGS. 1A–4B, a first embodiment of the dispenser 100 of the present invention will be described in detail.

Figure 1A:
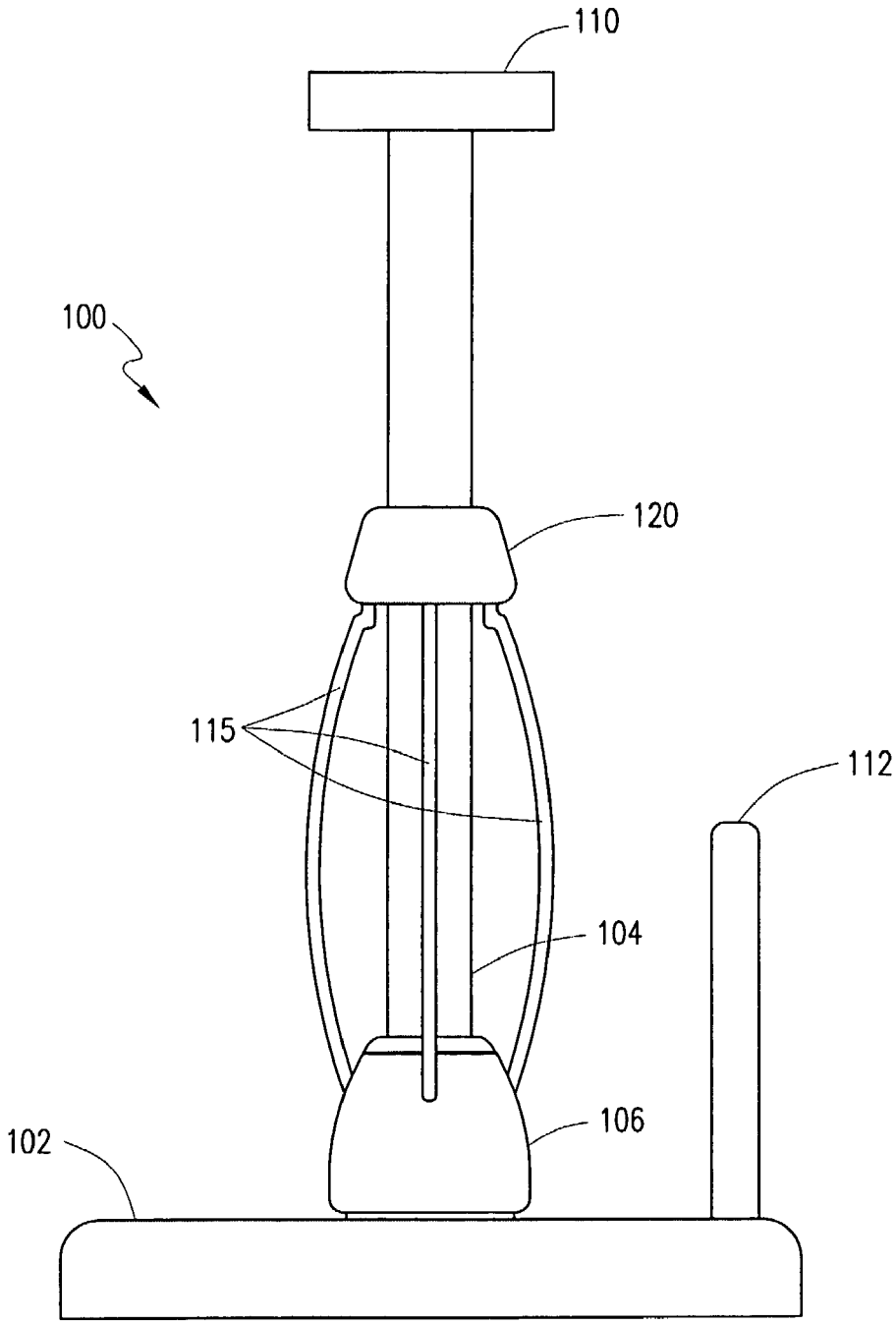
FIG. 1A is a side view of the dispenser incorporating a rotation mechanism in accordance with the present invention.

The dispenser 100 is supported by a base 102, which is preferably weighted in the embodiment shown and may include one or more suction cups. A rod 104 extends vertically from the base 102. A spinner 106 is located at one end of, and rotatable about, the rod 104, preferably proximate to the base 102 as shown in FIG. 1A. A cap 120 is located on, and rotatable about, the rod 104 towards an end opposite the spinner 106. A plurality of flexible wires 115 are connected at one end to the cap 120 and at the other end to the spinner 106. The wires 115 bow outward and may be deformable to provide a snug fit to the inside surface of a roll of sheets being dispensed (not shown). The wires 115 thus ensure that the roll, cap 120, and spinner 106 all rotate together about the rod 104 as a unit, e.g., a rotation mechanism, with no slippage of the roll with respect to the rotation mechanism.

Figure 1B:
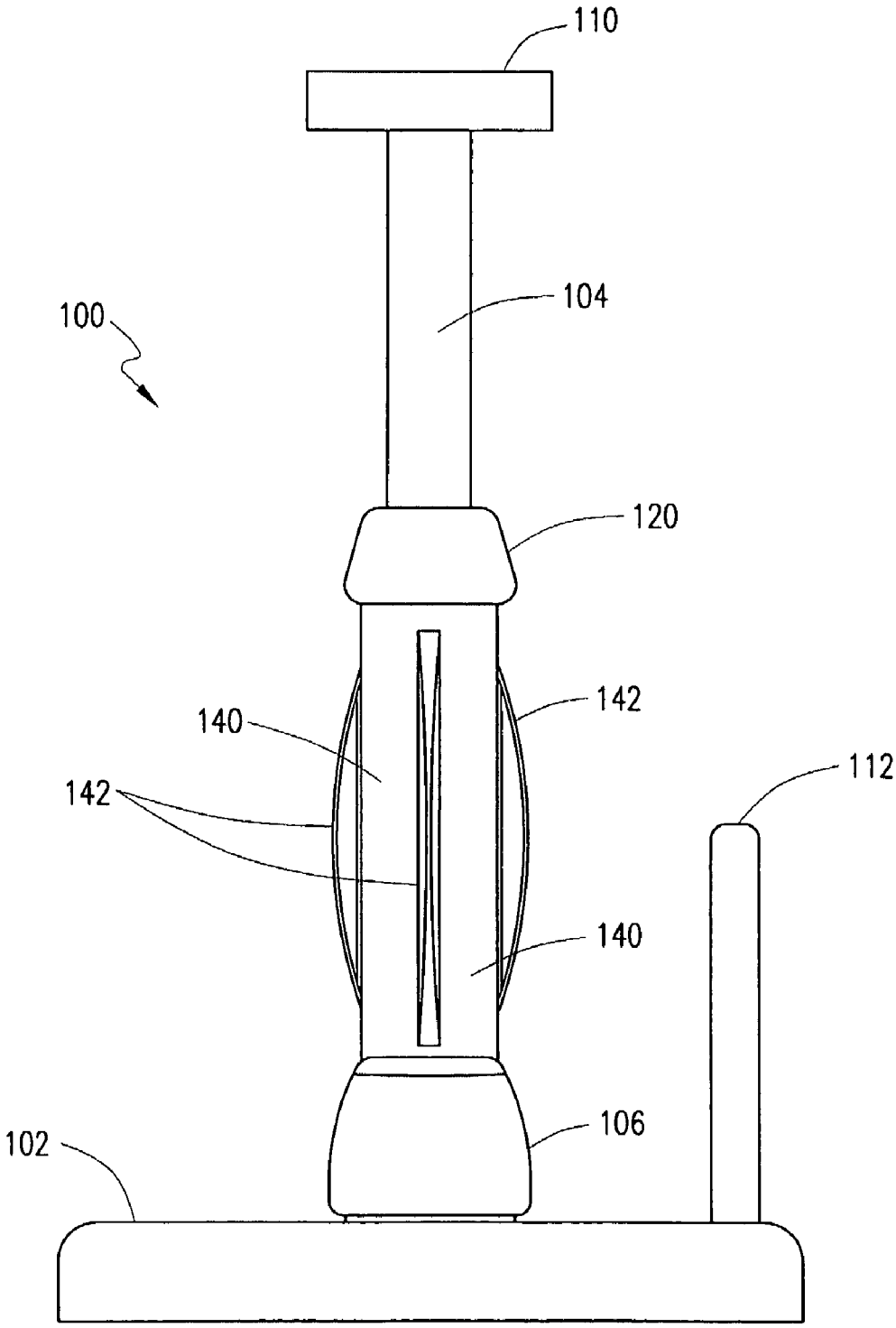
FIG. 1B is a side view of the dispenser incorporating a rotation mechanism in accordance with an alternate embodiment of the present invention.

According to an alternate embodiment of the present invention, the plurality of flexible wires 115 are replaced by a cylindrical body 140 (FIG. 1B). The cylindrical body 140 is connected at one end to the cap 120 and at the other end to the spinner 106. In an alternative implementation, the spinner 106, cap 120 and body 140 may be a unitary structure. The cylindrical body 140 includes a plurality protrusions 142 arching outwards to perform a snug fit to the inside surface of the roll of the sheets being dispensed (not shown). The cylindrical body 140 and the protrusions 142 thus ensure that the roll, cap 120, and spinner 106 all rotate together about the cylindrical body 140 as a unit, e.g., a rotation mechanism, with no slippage of the roll with respect to the rotation mechanism.

According to an embodiment of the present invention, a tear bar 112 may be located on the base 102. The tear bar 112 acts as a support for dispensing desired quantity of material from the roll.

In yet another embodiment, a head piece 110 may be located at the end of the rod 104 opposite to the spinner 106. The head piece 110 has an outer diameter sized to fit loosely within the end of a roll or tube of the type used for paper, plastic or foil goods supplied in rolled sheets. The head piece 110 functions to stabilize the roll or tube on the rod 104 during rotation. It will be understood that in some embodiments, the cap 120 can be used in place of the head piece 110. In some embodiments, the head piece 110 may fit more snugly to the roll and may be rotatable about the rod 104.

Figure 2A:
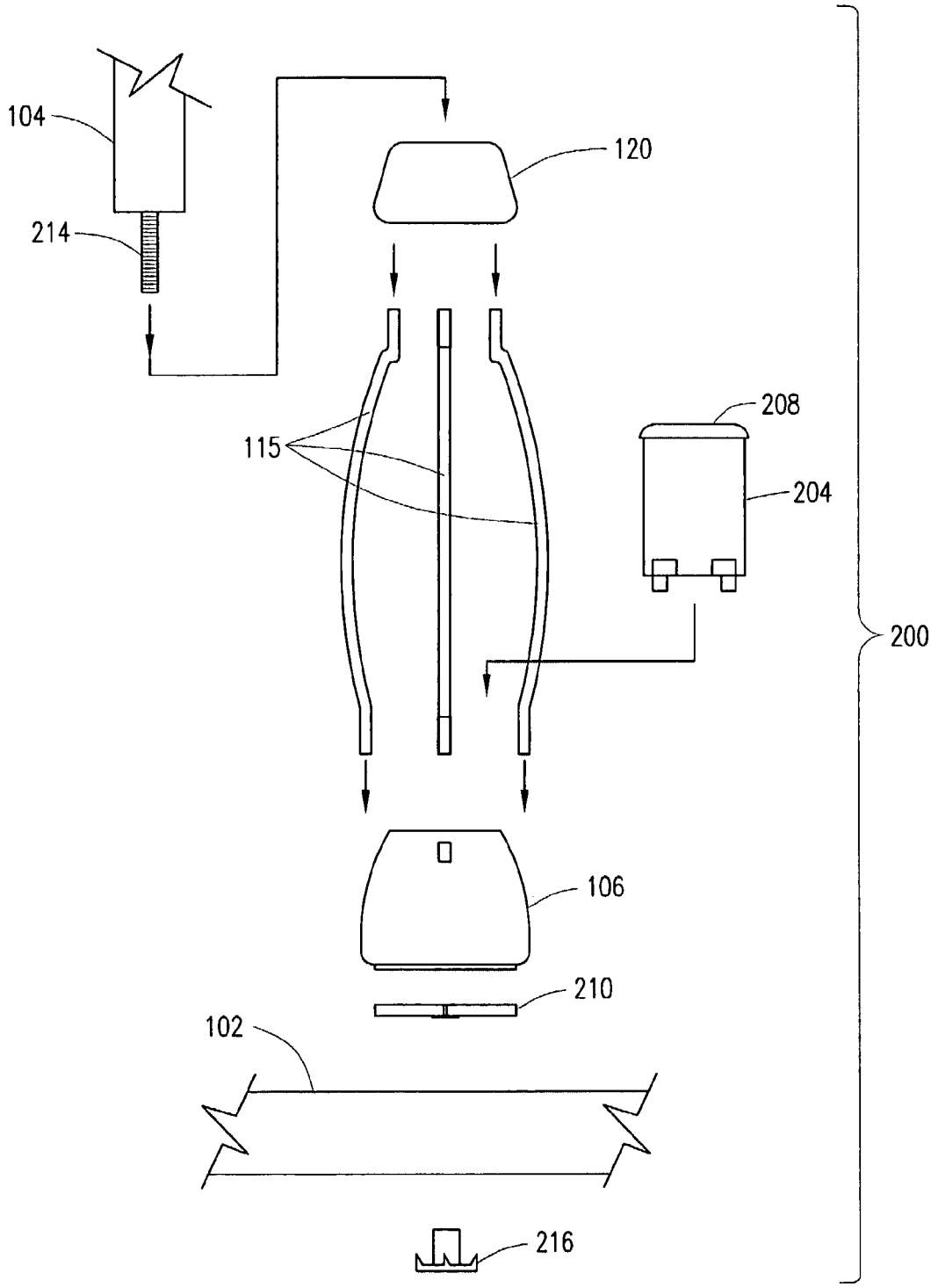
FIG. 2A is an exploded view of the rotation mechanism of FIG. 1A in accordance with the present invention.

FIG. 2A illustrates an exploded view of the rotation mechanism 200 according to an embodiment of the present invention. The rod 104 inserts through the cap 120 and into a sleeve 204. The spinner 106 is disposed on and freely rotatable about the sleeve 204. Preferably, a collar 208 is provided on the sleeve 204 for the purpose of retaining the spinner 106 on the sleeve 204. A friction mechanism including a friction disc 210 is disposed between the sleeve 204 and the base 102 to act upon the spinner 106. A screw stud 214 on the end of the rod 104 passes through apertures in the sleeve 204 and friction disc 210, and engages a retaining nut 216 within the base 102.

Figure 2B:
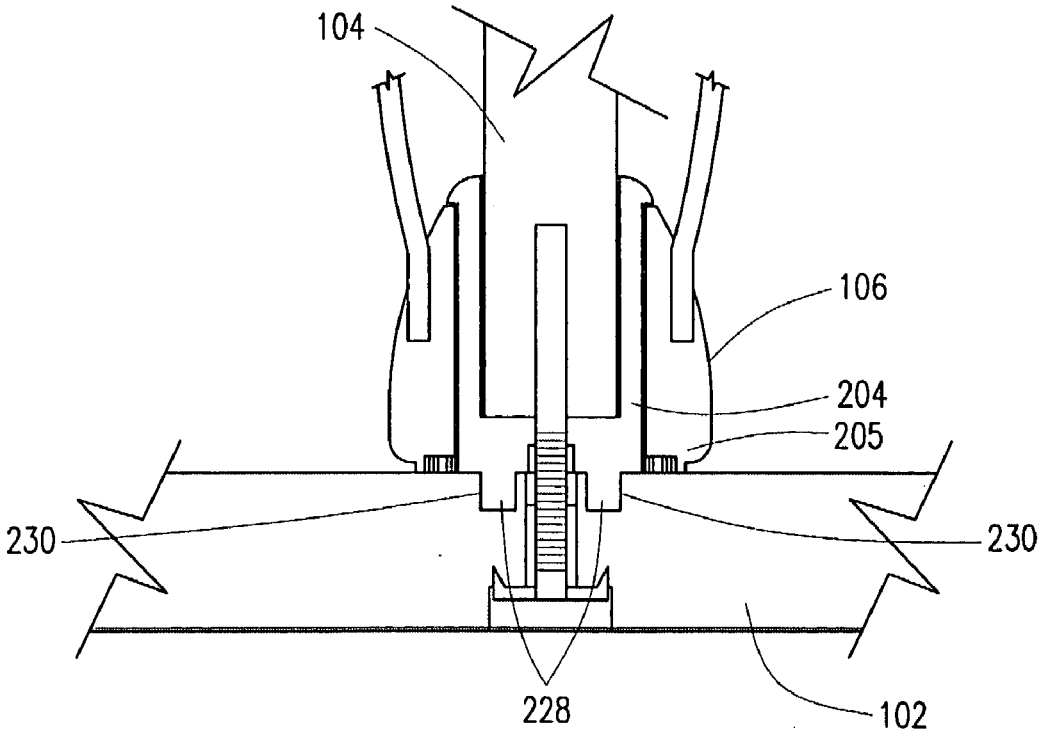
FIG. 2B is a cross-sectional view of a portion of the rotation mechanism of FIG. 1A in accordance with the present invention.

FIG. 2B illustrates a cross-sectional view of a portion of the rotation mechanism as assembled. Preferably, the sleeve 204 is provided with rotation locks 228, which engage slots 230 in the base 102, thus preventing rotation of the rod 104 and sleeve 204 as the spinner 106 rotates.

Figure 3A:
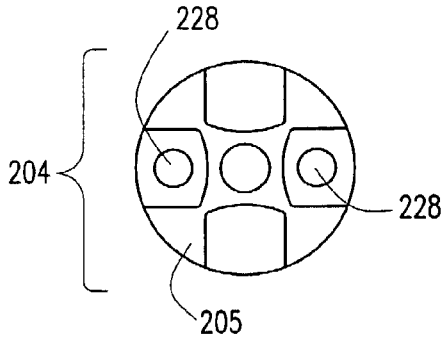
FIG. 3A is a bottom plan view of the sleeve in accordance with the present invention.

FIG. 3A illustrates a bottom plan view of the sleeve 204. The sleeve 204 has a recessed area 205 in which the friction disc 210 is situated. According to an embodiment of the present invention, the sleeve 204 can be formed from a variety of soft/hard material (such as injected molded plastic, rubber, cast alloy etc.).

Figure 3B:
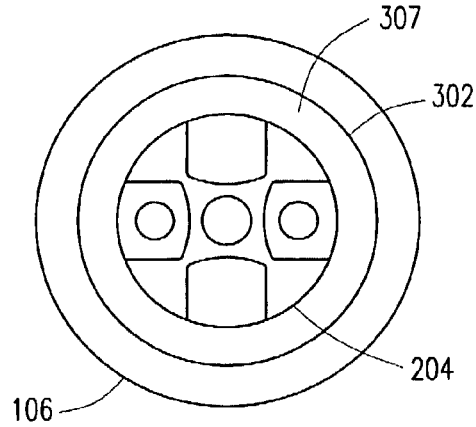
FIG. 3B is a bottom plan view of the spinner and sleeve in an assembled state in accordance with the present invention.
Figure 3C:
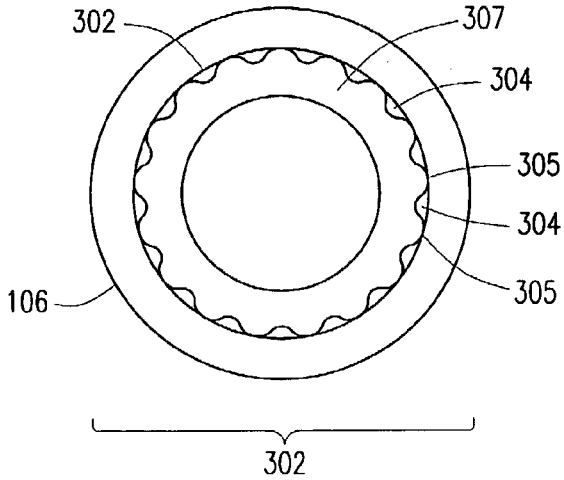
FIG. 3C illustrates the circumferential ridges in accordance with the present invention.

FIG. 3B illustrates a bottom plan view of the spinner 106 and the sleeve 204 in an assembled state. The spinner 106 is generally tubular in shape and may preferably be tapered at the head end as shown in FIGS. 2A and 2B. A concentric depression 307 is defined by the inner circumference 302. The inner circumference 302 has a plurality of ridges 304 and divots 305 thereon. Details of the inner circumference 302, as defined by the ridges 304 and divots 305, of the spinner 106 are shown in FIG. 3C. According to an embodiment of the present invention, the spinner 106 can be formed from a variety of soft/hard material (such as injected molded plastic, rubber, cast alloy etc.).

Figure 4A:
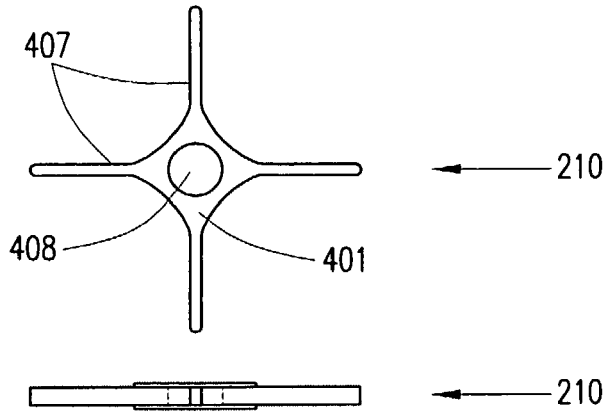
FIG. 4A is a top plan view and a side view of the friction disc according to an embodiment of the present invention.

FIG. 4A illustrates a top plan view and a side view of one embodiment for the friction disc 210. Extending from a core 401 are a plurality of flexible protrusions 407. A centered aperture 408 allows the passage of the screw stud 214 during assembly.

Figure 4B:
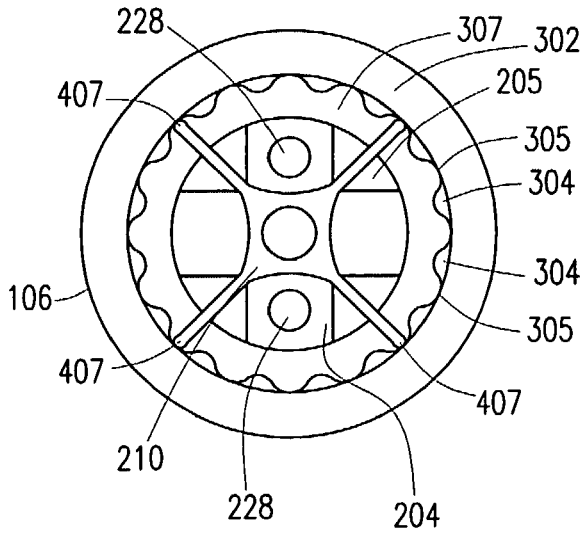
FIG. 4B is a bottom plan view of the spinner, sleeve and the friction disc in an assembled state according to an embodiment of the present invention.

FIG. 4B illustrates a bottom plan view of the spinner 106, the sleeve 204, and the friction mechanism including a friction disc 210 in an assembled state. The friction disc 210 is disposed with the protrusions 407 extending through the recessed areas 205 of the sleeve 204 and the friction disk 210 positioned in the concentric depression 307 of the spinner 106. The friction disc 210, like the sleeve 204, remains stationary as the spinner 106 rotates. In this embodiment the friction disc 210 is held stationary in the recessed areas 205 of the sleeve 204, the sleeve 204 being held stationary by the rotation locks 228. The protrusions 407 of the friction disc 210 can flex side to side in the plane of the friction disc 210 as the ridges 304 of the spinner 106 engage the ends of the protrusions 407. The protrusions 407 are sized such that they loosely engage the divots 305 between the ridges 304 in the circumference 302. As the spinner 106 rotates, the protrusions 407 ride over the ridges 304 and flex sideways. This action allows desired quantities of material to be unwound from a roll of paper, plastic, tape, foil or other rolled product. The action of the protrusions 407 alternately riding over the ridges 304 and engaging the divots 305 creates a clicking sound as the spinner 106 rotates. Once the desired quantity has been unwound, the resistance created by the engagement of the fingers in the divots 305 allows the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

Figure 5A:
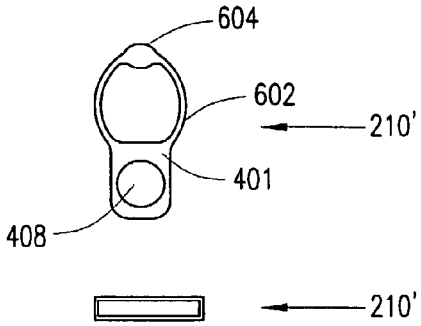
FIG. 5A is a top plan view and a side view of the friction disc according to an alternate embodiment of the present invention.

FIG. 5A illustrates an alternate embodiment of the friction disc 210' according to the present invention. The friction disc 210' comprises a loop 602 extending from the core 401, while the centered aperture 408 allows the passage of the screw stud 214. A protrusion 604 extends from an outer surface of the loop 602 to engage the divots 305 between the ridges 304 in the circumference 302 (FIG. 3C).

Figure 5C:
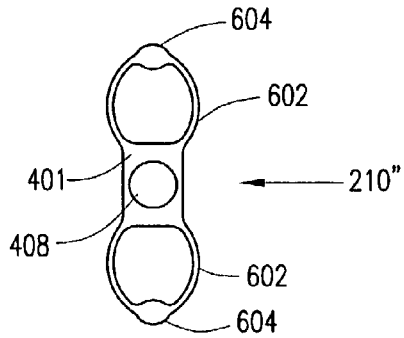
FIG. 5C is a top plan view of the friction disc according to yet another alternate embodiment of the present invention.
Figure 5B:
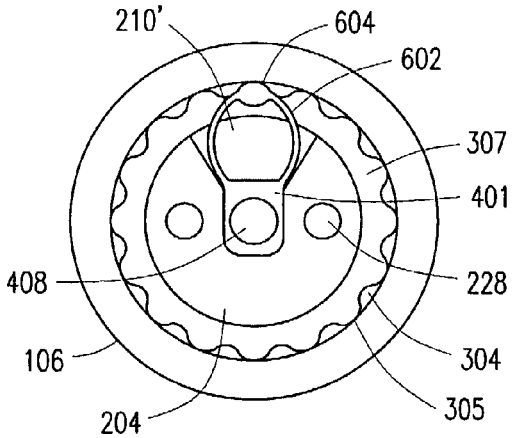
FIG. 5B is a bottom plan view of the spinner, sleeve and the friction disc in an assembled state according to an alternate embodiment of the present invention.

FIG. 5B illustrates a bottom plan view of the spinner 106, the sleeve 204, and the friction mechanism including a friction disc 210' in an assembled state. The friction disc 210' extends through the recessed areas 205 of the sleeve 204 and is positioned in the concentric depression 307 of the spinner 106. The friction disc 210', like the sleeve 204, remains stationary as the spinner 106 rotates. In this embodiment the friction disc 210' is held stationary in the recessed areas 205 of the sleeve 204, the sleeve 204 being held stationary by the rotation locks 228. The loop 602 can flex and deform as the ridges 304 (FIG. 3C) of the spinner 106 engage protrusion 604. As the spinner 106 rotates, the protrusion 604 rides over the ridges 304. This action allows desired quantities of material to be unwound from a roll of paper, plastic, foil or other rolled product. The action of the protrusion 604 alternately riding over the ridges 304 and engaging the divots 305 creates a clicking sound as the spinner 106 rotates. The resistance created by the engagement of the protrusion 604 in the divots 305 allow the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

FIG. 5C illustrates an alternate embodiment of the friction disc 210" according to the present invention. The friction disc 210" is substantially similar to the one disclosed earlier with respect to FIG. 5A, however, the friction disc 210" in this embodiment comprises a plurality of loops 602 extending from the core 401, while the centered aperture 408 allows the passage of the screw stud 214. A plurality of protrusions 604 extend from an outer surface of the loop 602 to engage the divots 306 between the ridges 304 in the circumference 302 (FIG. 3C).

Figure 5D:
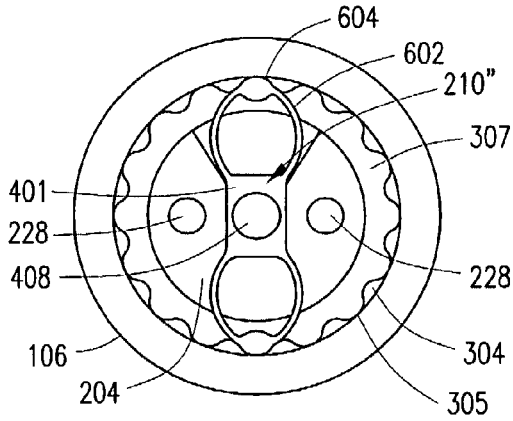
FIG. 5D is a bottom plan view of the spinner, sleeve and the friction disc in an assembled state according to an alternate embodiment of the present invention.

FIG. 5D illustrates a bottom plan view of the spinner 106, the sleeve 204, and the friction mechanism including a friction disc 210" in an assembled state. As the spinner 106 rotates, the protrusions 604 rides over the ridges 304. This action allows desired quantities of material to be unwound from a roll of paper, plastic, foil or other rolled product. The action of the protrusions 604 alternately riding over the ridges 304 and engaging the divots 305 creates a clicking sound as the spinner 106 rotates. The resistance created by the engagement of the protrusions 604 in the divots 305 allow the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

Figure 5E:
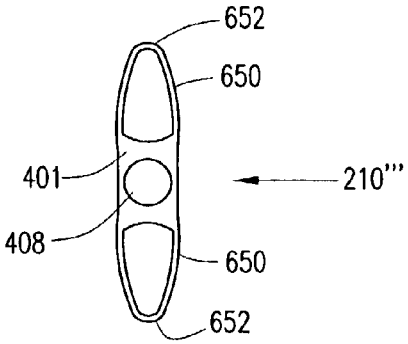
FIG. 5E is a top plan view of the friction disc according to yet another alternate embodiment of the present invention.

FIG. 5E illustrates an alternate embodiment of the friction disc 210''' according to the present invention. The friction disc 210''' comprises a plurality of elongated loops 650 extending from the core 401, while the centered aperture 408 allows the passage of the screw stud 214. A plurality of circular edges 652 extend from an outer surface of the loops 650 to engage the divots 306 between the ridges 304 in the circumference 302 (FIG. 3C).

Figure 5F:
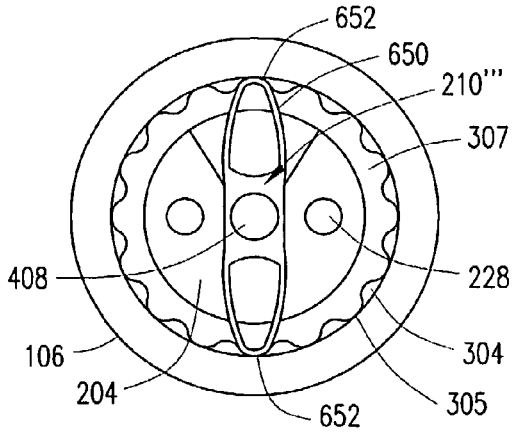
FIG. 5F is a bottom plan view of the spinner, sleeve and the friction disc in an assembled state according to an alternate embodiment of the present invention.

FIG. 5F illustrates a bottom plan view of the spinner 106, the sleeve 204, and the friction mechanism including a friction disc 210''' in an assembled state.

Figure 6A:
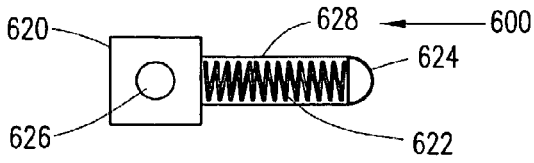
FIG. 6A is a top plan view of the friction mechanism according to yet another alternate embodiment of the present invention.

FIG. 6A illustrates a top plan view of an alternate embodiment of the friction mechanism 600 according to the present invention. The friction mechanism 600 includes a hub 620, a spring mechanism 622 and a plunger 624. Extending from the hub 620 in a shaft 628 is the spring mechanism 622, which includes the plunger 624 attached to an end of the spring mechanism 622. A centered aperture 626 allows the passage of the screw stud 214. According to an embodiment of the invention, the plunger can be made of rubber, plastic, metal, etc.

Figure 6C:
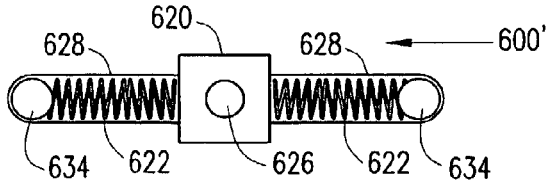
FIG. 6C is a top plan view of the friction mechanism according to yet another alternate embodiment of the present invention.
Figure 6B:
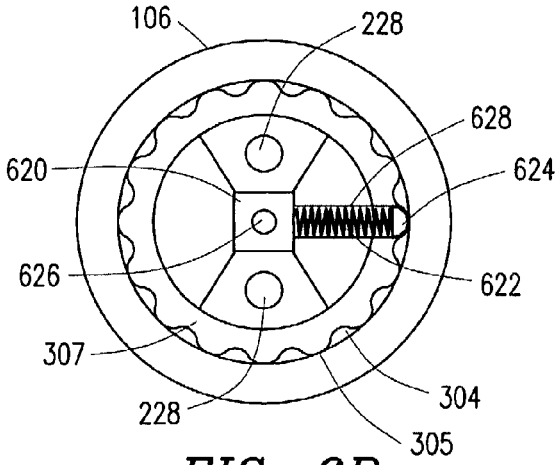
FIG. 6B is a bottom plan view of the spinner, sleeve and the friction mechanism in an assembled state according to an alternate embodiment of the present invention.

FIG. 6B illustrates a bottom plan view of the spinner 106, the sleeve 204, and the friction mechanism 600 (as shown in FIG. 6A) in an assembled state. The spring mechanism 622 extends through the recessed area 205 of the sleeve 204 and is positioned in the concentric depression 307 of the spinner 106. In this embodiment the hub 620 of the friction mechanism 600 is held stationary by the screw stud 214, while the sleeve 204 is held stationary by the rotation locks 228. The spring mechanism 622 can compress in the plane of the friction mechanism 600 within the shaft 628 as the ridges 304 (FIG. 3C) of the spinner 106 engage the plunger 624 of the spring mechanism 622. The spring mechanism 622 decompresses in the shaft 628 to loosely engage the divots 305 between the ridges 304 in the circumference 302. As the spinner 106 rotates, the spring mechanism 622 compresses and decompresses as the plunger 624 rides over the ridges 304 and divots 305. This action allows desired quantities of material to be unwound from a roll of paper, plastic, tape, foil, or other rolled product. The action of the plunger 624 alternately riding over the ridges 304 and engaging the divots 305 creates resistance as the spinner 106 rotates. The resistance created by the engagement of the plunger 624 in the divots 305 allows the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

FIG. 6C illustrates a top plan view of an alternate embodiment of the friction mechanism 600' according to the present invention. The friction mechanism 600' is substantially similar to the one disclosed earlier with respect to FIG. 6A, however, the friction mechanism 600' in this embodiment comprises a plurality spring mechanisms. In addition, the plunger 624 attached to the end of the spring mechanism 622 (FIG. 6A) can be replaced by a spring loaded ball bearing 634 attached to each end of the spring mechanism 622.

Figure 6D:
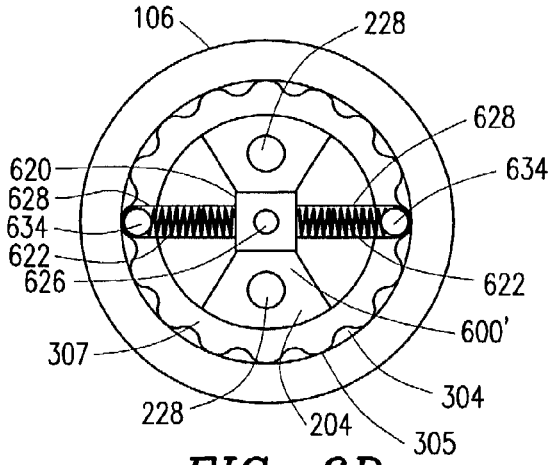
FIG. 6D is a bottom plan view of the spinner, sleeve and the friction mechanism in an assembled state according to an alternate embodiment of the present invention.

FIG. 6D illustrates a bottom plan view of the spinner 106, the sleeve 204, and the friction mechanism 600' (as shown in FIG. 6C) in an assembled state. The spring mechanisms 622 extend through the recessed area 205 of the sleeve 204 and are positioned in the concentric depression 307 of the spinner 106. In this embodiment the hub 620 of the friction mechanism 600' is held stationary by the screw stud 214, while the sleeve 204 is held stationary by the rotation locks 228. The spring mechanisms 622 can compress in the plane of the friction mechanism 600' within the shafts 628 as the ridges 304 (FIG. 3C) of the spinner 106 engage the plunger 624 of the spring mechanisms 622. The spring mechanisms 622 decompress in the shafts 628 to loosely engage the divots 305 between the ridges 304 in the circumference 302. As the spinner 106 rotates, the spring mechanisms 622 compress and decompress as the ball bearings 634 ride over the ridges 304 and divots 305. This action allows desired quantities of material to be unwound from a roll of paper, plastic, tape, foil, or other rolled product. The action of the ball bearings 634 alternately riding over the ridges 304 and engaging the divots 305 creates resistance as the spinner 106 rotates. The resistance created by the engagement of the ball bearings 634 in the divots 305 allows the material to be removed from a roll without undesired material coming unraveled. According to an embodiment of the present invention, the spinner 106 and the sleeve 204 can be formed from a variety of soft/hard material (such as injected molded plastic, rubber, cast alloy etc.). In addition, according to an embodiment of the present invention, either the spinner 106 or the sleeve 204 or both can be formed from a material having substantially lesser surface resistivity and material hardness than the other.

In another embodiment of the, the plurality of ball bearings 634 can be replaced by a plurality of plungers 624 (FIG. 6A).

Figure 6E:
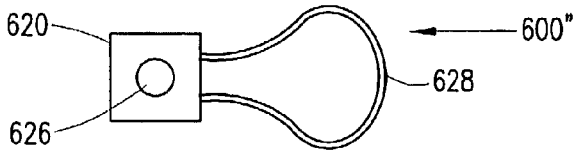
FIG. 6E is a top plan view of the friction mechanism according to yet another alternate embodiment of the present invention.

In yet another alternate embodiment, the friction mechanism 600" comprises a circular loop extending from the hub 620, while the centered aperture 626 allows the passage of the screw stud 214 (FIG. 6E). This friction mechanism 600" is assembled for operation in a manner similar to that shown in FIGS. 6A and 6C.

Figure 6F:
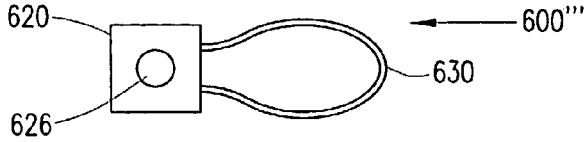
FIG. 6F is a top plan view of the friction mechanism according to yet another alternate embodiment of the present invention.

In yet another alternate embodiment, the friction mechanism 600'" comprises an elongated loop 630 extending from the hub 620, while the centered aperture 626 allows the passage of the screw stud 214 (FIG. 6F). This friction mechanism 600'" is assembled for operation in a manner similar to that shown in FIGS. 6A and 6C.

Figure 7A:
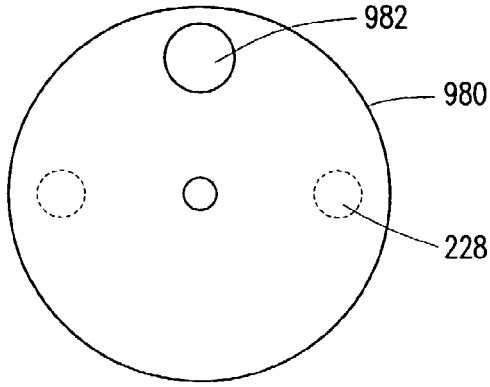
FIG. 7A is a top plan view of the sleeve in accordance with an alternate embodiment of the present invention.

FIG. 7A illustrates a top view of an alternative embodiment of the sleeve 204 according to the present invention. The sleeve 204 is substantially solid and generally circular and disc-like in shape and comprises a smooth outer circumference 980. Mounted within the sleeve 204 near the circumference 980 is a vertical cylindrical channel retaining a spring loaded ball bearing 982 (see, also, FIG. 7C). The spring loaded ball bearing 982 acts as a source of friction as will be described.

Figure 7B:
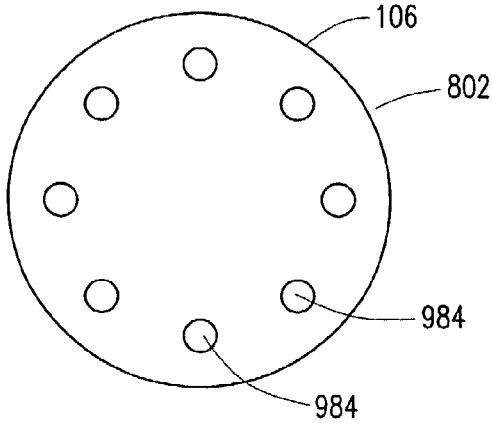
FIG. 7B is a bottom plan view of the spinner in accordance with an alternate embodiment of the present invention.

FIG. 7B illustrates a bottom view of an alternative embodiment of the spinner 106 according to the present invention. The spinner 106 is substantially solid and generally circular and disc-like in shape and comprises a smooth outer circumference 802. The circumference 802 may be slightly larger than the circumference 980. A bottom surface of the spinner 106, comprises a plurality of detents 984 arranged about the circumference 802 which are sized and shaped to receive and engage a surface of the spring loaded ball bearing 982 (FIG. 7A).

Figure 7C:
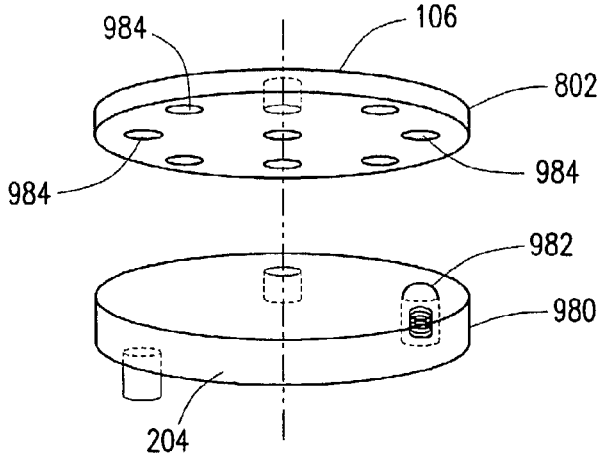
FIG. 7C is an exploded perspective view of the spinner and the sleeve according to yet another alternate embodiment of the present invention.

FIG. 7C illustrates a disassembled perspective view of the spinner 106 (FIG. 7B) and the sleeve 204 (FIG. 7A). In this embodiment, the sleeve 204 is held stationary by the rotation locks 228 (and passage of the rod 104). The spring loaded ball bearing 982 (FIG. 7A) engages the plurality of detents 984 (FIG. 7B) as the spinner 106 rotates. The detents 984 are sized such that they loosely engage the spring loaded ball bearing 982. As the spinner 106 rotates, the spring loaded ball bearing 982 creates a resistive holding force when the detents 984 on the bottom surface of the spinner 106 rotate into position to engage the ball bearing 982. This allows a desired quantity of material to be unwound from a roll or paper, plastic, tape, foil or other rolled product. The resistance created by the ball bearing 982 movement into the detents 984 on the surface of the spinner 106 allows the material to be removed from a roll without undesired material coming unraveled.

Figure 8:
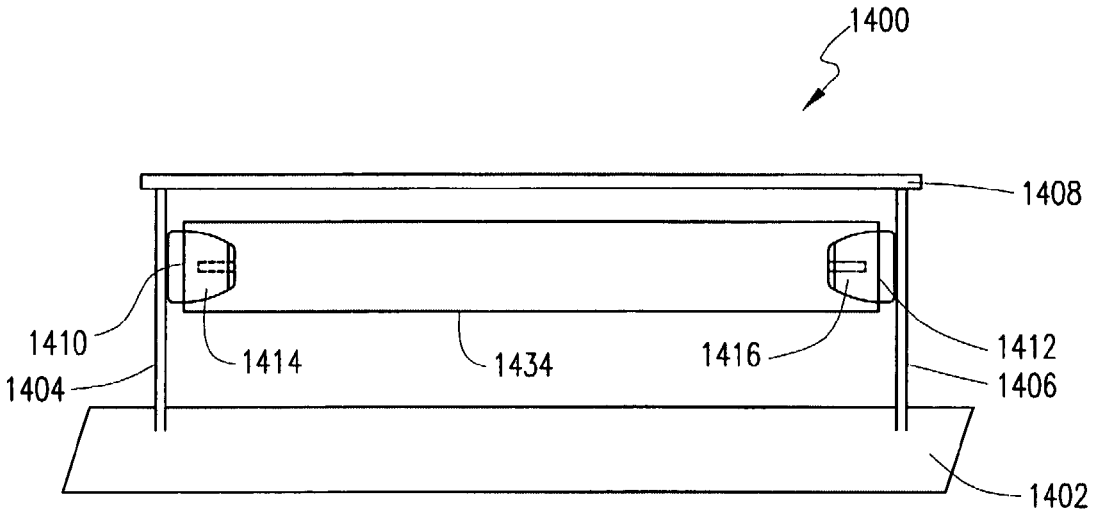
FIG. 8 is a side view of the dispenser incorporating a plurality of rotation mechanisms in accordance with an alternate embodiment of the present invention.

FIG. 8 depicts a side view of the dispenser 1400 according to another embodiment of the present invention. The dispenser 1400 is supported by a base 1402, which is preferably weighted in the embodiment shown and may include one or more suction cups. A plurality of bars 1404 and 1406 extend vertically from either end of the base 1402. A head piece 1408 may be located towards the ends of the vertical bars 1404 and 1406 opposite to the base 1402. The head piece 1408 functions to stabilize the roll or tube 1434 during rotation. The head piece 1408 can also function as a tear bar. It will be understood that in some embodiments, the head piece 1408 can be eliminated.

A first spinner/sleeve 1410 is located at a location on the vertical bar 1404. A second spinner/sleeve 1412 is located at a location on the vertical bar 1406 such that the first spinner 1410 and the second spinner 1412 are substantially at the same height. According to embodiments of the present invention, the spinners/sleeves 1410 and 1412 are configured like the spinners/sleeves disclosed earlier with respect to FIGS. 2A–7C. A first rod 1414 extends horizontally outwards from the vertical bar 1404 in the direction of vertical bar 1406. A second rod 1416 extends horizontally outwards from the vertical bar 1406 in the direction of vertical bar 1404. The first rod 1414 inserts into the first spinner/sleeve 1410 similar to the configuration of rod 104 disclosed earlier with respect to FIG. 2A. The second rod 1416 inserts into the second spinner/sleeve 1412 similar to the configuration of rod 104 disclosed earlier with respect to FIG. 2A. The spinners 1410 and 1412 and the roll rotate together about the rods 1414 and 1416 as a unit, e.g., a rotation mechanism, with no slippage of the roll with respect to the rotation mechanism.

Figure 9:
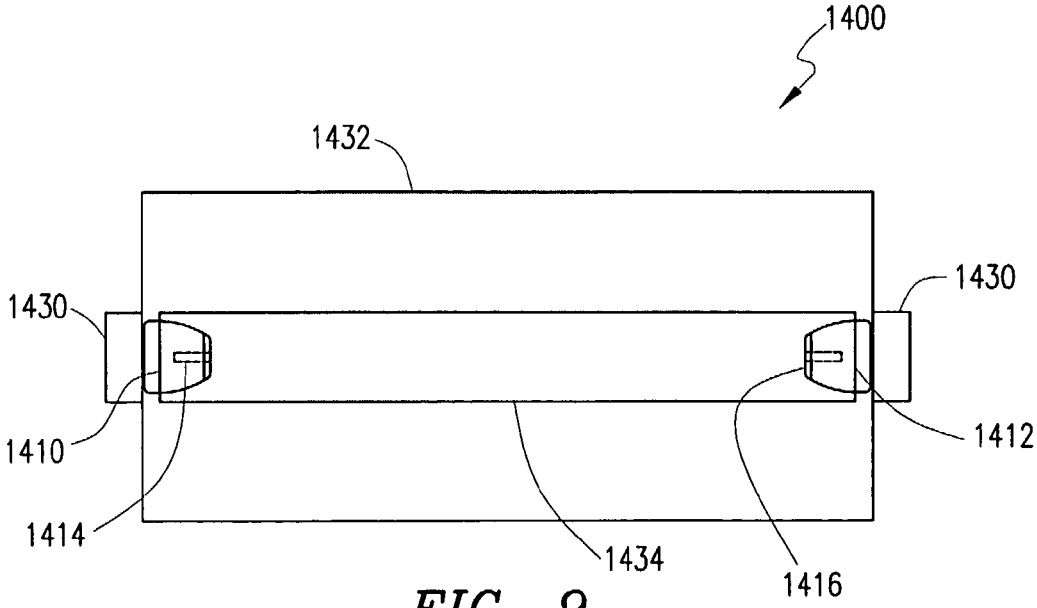
FIG. 9 is a side view of the dispenser mounted horizontally and incorporating a plurality of rotation mechanisms according to an alternate embodiment of the present invention.

Referring to FIG. 9, an alternate embodiment of the dispenser 1400 suitable for mounting horizontally on a wall is shown. A base 1430 allows the horizontal mounting. Also shown is a roll of material to be dispensed 1432 wrapped on a tube 1434 and positioned on the dispenser 1400.

While the embodiments described herein are intended as an exemplary dispenser (for paper, plastic, foil), it will be appreciated by those skilled in the art that the present invention is not limited for dispensing paper, and may be employed for dispensing any sheet product supplied on rolls or tubes of any length, for household or industrial purposes.

Although preferred embodiments of the different dispensers of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A dispenser for a product oriented on a roll, the dispenser comprising:

a head piece for stabilizing the roll;

a rotation mechanism comprising:

means for engaging an inner surface of the roll;

a freely rotating cap for receiving a first end portion of the engaging means;

a sleeve having an upper end and a lower end, the upper end having a circumferential collar;

a freely rotating spinner disposed on and being freely rotatable about the sleeve, the spinner for receiving a second end portion of the engaging means;

a friction mechanism for providing resistance to the freely rotating spinner; and a rod having a first end region and a second end region, said first end region contacting the head piece and said second end region contacting the spinner.

2. The dispenser of claim 1, wherein the engaging means comprises a plurality of flexible wires.

3. The dispenser of claim 1, wherein the engaging means further comprises a cylindrical body including a plurality of protrusions arching outwards.

4. The dispenser of claim 1, further comprising a base member in contact with the second end region of the rod.

5. The dispenser of claim 4, wherein the base member includes a tear bar.

6. The dispenser of claim 4, wherein the base member is configured to support the product in a vertical orientation.

7. The dispenser of claim 4, wherein the base member is configured to support the product in a horizontal orientation.

8. The dispenser of claim 1, wherein the product comprises at least one of paper towels and toilet paper.

9. The dispenser of claim 1, wherein the spinner is substantially circular in shape and comprises a concentric depression therein including a plurality of circumferential ridges and divots.

10. The dispenser of claim 9, wherein the friction mechanism further comprises a friction disc positioned in the concentric depression.

11. The dispenser of claim 10, wherein the friction disc comprises a core and a plurality of protrusions extending from the core for engaging the freely rotating spinner.

12. The dispenser of claim 11, wherein the plurality of protrusions loosely engages the plurality of ridges and divots such that when the spinner rotates, the plurality of protrusions ride over the plurality of ridges and engages the divots generating resistance to the rotation.

13. The dispenser of claim 10, wherein the friction disc further comprises a loop extending from a core.

14. The dispenser of claim 13, wherein the friction disc further comprises a protrusion extending from an outer surface of the loop and engages the plurality of ridges and divots such that when the spinner rotates, the protrusion rides over the plurality of ridges and engages the divots generating resistance to the rotation.

15. The dispenser of claim 9, wherein the friction mechanism further comprises a hub, at least one spring mechanism and a plunger attached to an end of the spring mechanism.

16. The dispenser of claim 15, wherein the at least one spring mechanism extends from the hub and is positioned in the concentric depression.

17. The dispenser of claim 16, wherein the plunger engages the freely rotating spinner.

18. The dispenser of claim 17, wherein the plunger loosely engages the plurality of ridges and divots such that when the spinner rotates, the plunger rides over the plurality of ridges and engages the divots generating resistance to the rotation.

19. The dispenser of claim 9, wherein the friction mechanism further comprises a hub, at least one spring mechanism and a ball bearing attached to an end of the spring mechanism and positioned in the concentric depression for engaging the freely rotating spinner.

20. The dispenser of claim 9, wherein the friction mechanism further comprises a hub and a circular loop extending from the hub and positioned in the concentric depression for engaging the freely rotating spinner.

21. The dispenser of claim 9, wherein the friction mechanism further comprises a hub and an elongated loop extending from the hub and positioned in the concentric depression for engaging the freely rotating spinner.

* * * * *